United States Patent [19]

Barot

[11] Patent Number: 4,574,002

[45] Date of Patent: Mar. 4, 1986

[54] COAL GASIFICATION COMBUSTION CHAMBER STRUCTURE

[75] Inventor: Devendra T. Barot, W. Covina, Calif.

[73] Assignee: Texaco Inc., White Plains, N.Y.

[21] Appl. No.: 615,658

[22] Filed: May 24, 1984

[51] Int. Cl.[4] ..... C10J 3/48; C10J 3/72

[52] U.S. Cl. ..... 48/77; 48/DIG. 2

[58] Field of Search ..... 48/61, 62 R, 63, 76, 48/77, DIG. 2, DIG. 4, 210; 110/165 R

[56] References Cited

U.S. PATENT DOCUMENTS

| | | | |
|---|---|---|---|
| 1,995,567 | 3/1935 | Franklin | 110/265 |
| 4,022,591 | 5/1977 | Staudinger | 48/76 |
| 4,289,502 | 9/1981 | Muenger et al. | 48/62 R |
| 4,352,675 | 10/1982 | Seipenbusch et al. | 48/77 |
| 4,364,744 | 12/1982 | Crouch et al. | 48/DIG. 7 |

FOREIGN PATENT DOCUMENTS

| | | | |
|---|---|---|---|
| 3041304 | 4/1978 | Japan | 48/77 |

OTHER PUBLICATIONS

Hsue-Shen Tsien, On the Design of the Contraction Cone for a Wind Tunnel, Feb. 1943, pp. 68-70, vol., Journal of Aeronautical Science.

*Primary Examiner*—Jay H. Woo
*Assistant Examiner*—Joye L. Woodward
*Attorney, Agent, or Firm*—Robert A. Kulason; James J. O'Loughlin; Henry C. Dearborn

[57] ABSTRACT

A combustion chamber for powdered coal and the like having a refractory lined floor with an exit throat at the bottom. The throat is shaped approximately in accordance with the ratios employed in a contraction cone of a wind tunnel to produce a monotonic increase in flow therethrough in order to avoid any clogging by liquid slag and fly ash.

1 Claim, 5 Drawing Figures

COAL GASIFICATION COMBUSTION CHAMBER STRUCTURE

This invention concerns coal gasification, in general. More specifically it relates to an improvement in the structure of a refractory lined combustion chamber.

BACKGROUND OF THE INVENTION

In coal gasification and particularly in connection with finely divided coal, the procedure using a down flow generator having a bottom exit has encountered problems with the slag and fly ash that develops. Particularly in regard to the liquid slag, it tends to build up and clog the exit throat. Such a combustion chamber has a refractory lining, and in the previous structures it was constructed with the bottom exit being made into a funnel shape through which the hot gases and fly ash including liquid slag etc, must pass including the throat portion of such funnel exit. However, it has been found that such prior structure tended to recirculate the hot gases and fly ash at the bottom of the combustion chamber. Also, the gas velocity profile through the exit throat was parabolic in shape, i.e. lower velocity flow would develop near the sides of the throat with maximum velocity at the center. Such a velocity profile does not help to drain the slag, which being liquid tends to run along the walls of the throat at a lower velocity than the gas passing through.

The problem with removing non-carbonaceous residue that is produced during gasification in reactor apparatus, has been recognized in a U.S. Pat. No. 4,022,591, May 10, 1977 issued to Staudinger as patentee. However, the structure proposed in that patent deals with a generator having upwardly directed reactant supply tubes. And, those tubes are centrally located beneath an exit throat at the bottom of the generator. That arrangement was also concerned with the very high temperatures in the reactor and consequent difficulties with the reactor inlet tubes or the like. In addition, the structure of that patent creates a counter flow of coal and reactant gases to the by-product ash being removed.

BRIEF SUMMARY OF THE INVENTION

An object of this invention is to provide a structure that improves the operation of a generator in which the gasification process is downflow and with the bottom exit centrally located. Such a generator heretofore had a tendency to clog by reason of slag and fly ash accumulation at the exit throat.

Another object of the invention is to provide an improved structure for the bottom of a combustion chamber which has a refractory lined floor with a throat therethrough.

Briefly, the invention is in the combination of a down flow generator for coal gasification and the like, having an exit at the bottom of the combustion chamber thereof. It concerns the improvement which comprises means for monotonically increasing the fluid flow velocity through said exit whereby slag and fly ash are discharged evenly with discharge of said gasification products.

Again briefly, the invention is in combination with a combustion chamber for a finely divided solids gasification procedure, wherein said chamber has a refractory lined floor with a throat therethrough. It comprises means for monotonically increasing the flow of fluids through said throat whereby slag and fly ash will be prevented from clogging said chamber throat.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings, wherein.

DETAILED DESCRIPTION

Figure 1:
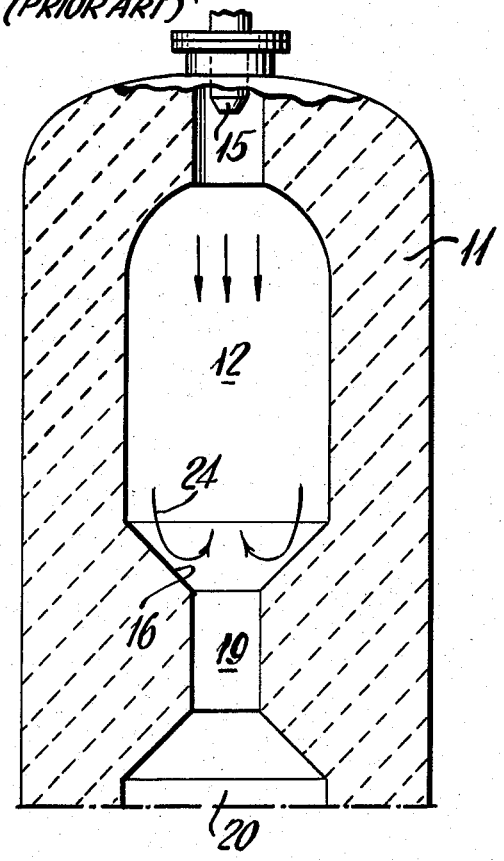
Fig. 1. (PRIOR ART)
FIG. 1 is a schematic cross-sectional view of a generator structure according to the prior art.

With reference to the figures of drawing, the FIG. 1 illustration indicates the prior art structure of a generator 11 that has a combustion chamber 12 into which the powdered coal and other reactant materials are introduced with a downward flow via a burner 15 at the top. The combustion chamber 12 has a floor 16 with a throat 19 centrally located therein. The combustion products flow out into a plenum chamber 20 below the throat 19.

Figure 2:
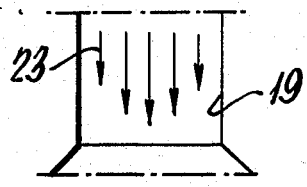
FIG. 2 is an enlarged diagrammatic illustration of the velocity profile of gas flow through the throat of FIG. 1.

FIG. 2 schematically illustrates a typical velocity profile of the products flowing through the throat 19. Thus, as indicated by the length of arrows 23, a velocity profile is parabolic in shape with the maximum velocity at the center and minimum velocities near the edges of the throat passageway 19. Also, as indicated in FIG. 1 there is apt to be a recirculation of the hot gases and fly ash in the manner indicated by arrows 24.

Figure 3:
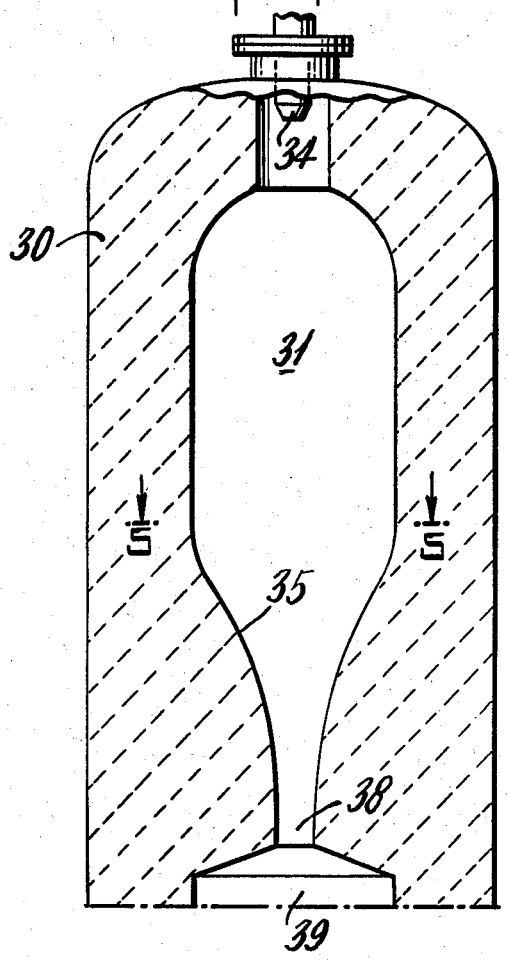
FIG. 3 is a schematic cross-sectional view illustrating a generator structure according to the invention.
Figure 5:
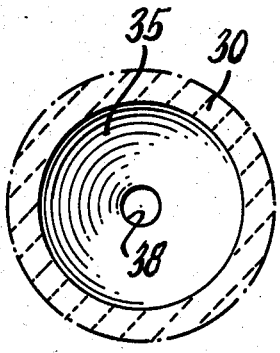
FIG. 5 is a cross-section view of the throat illustrated in FIG. 3, taken along the lines 5—5 and looking in the direction of the arrows.

FIGS. 3 and 5 illustrate the generator structure according to the invention. There is a generator 30 that has a combustion chamber 31 contained therein. Reactants are introduced from the top in a down-flow manner via a burner 34. At the lower end of the combustion chamber 31 there is a floor 35 which is circular in cross section with a centrally located exit therethrough ending at a throat 38. The throat 38 discharges into a plenum chamber 39 there beneath.

Figure 4:
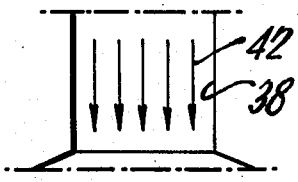
FIG. 4 is an enlarged diagrammatic illustration of the velocity profile of gas flow through the throat of the FIG. 3 structure.

The floor 35 is shaped such that it causes a monotonically increasing flow of the gases and other fluids from the combustion chamber 31 out through the throat 38. That flow condition is illustrated schematically by the FIG. 4 enlarged showing of the throat 38. Arrows 42 represent the velocity of the gas flow which is equal across the entire profile of the throat 38. By reason of this structure there is created substantially a plug flow of gases through the bottom or floor portion of the combustion chamber 31. Such monotonically increasing flow velocity continues all the way down through the throat 38. Consequently an accumulation of slag or fly ash materials is substantially prevented and the throat 38 does not become plugged up.

The proportions of the shaping of floor 35 according to this invention are in accordance with the ratios employed in a contraction cone of a wind tunnel. However, the exact formula for determining such shape is quite complex and a satisfactory streamlining to obtain an equal velocity profile may be accomplished with an approximation. For example, if the total vertical dimension of a floor e.g. floor 35 illustrated, which is made up of refractory material around an exit e.g. throat 38 illustrated, is thirty inches. And, if the combustion chamber e.g. chamber 31 illustrated, has a twenty inch diameter and the throat or bottom opening i.e. throat 38 has a diameter of four inches. Then, a streamlined shape like that illustrated in FIG. 3 may be developed whereby the flow of fluids through the exit will have an equal velocity profile diametrically across the throat. Thus, the foregoing example is illustrated by the following list of dimensions that are taken by moving from the top of the thirty inch vertical dimension downward. In the following table the column headed X represents the vertical distance down in inches, and the column headed R represents the radius in inches of the circular opening at that vertical location down the thirty inch vertical dimension.

| X | R |
|---|---|
| 0.00 | 10.00 |
| 3.24 | 9.00 |
| 6.30 | 8.00 |
| 8.60 | 6.50 |
| 11.40 | 5.00 |
| 16.00 | 3.50 |
| 23.00 | 2.55 |
| 30.00 | 2.00 |

It may be noted that in the prior art structure as illustrated in FIG. 1, a comparable combustion chamber having an inside diameter of twenty inches would have a lower exit opening or throat size of four inches diameter and a vertical height of only thirteen and ½ inches. Also, it would have a straight tapered surface cone from the twenty inch chamber bottom to a short distance above the four inch diameter throat opening. And, as mentioned above, it was such structural shape that tended to create a recirculation and to cause the parabolic flow velocity pattern that was described above in connection with the prior art.

While a particular embodiment of the invention has been described above in considerable detail, in accordance with the applicable statutes, this is not to be taken as in any way limiting the invention but merely as being descriptive thereof.

I claim:

1. In a down flow generator for coal gasification having a refractory lined floor with a throat therethrough ending in an exit for product gas, slag and fly ash, the improvement comprising said throat being round in cross-section and shaped approximately in accordance with the ratios employed in a contraction cone of a wind tunnel to produce monotonically increasing flow of fluid velocity therethrough whereby said product gas, slag and fly ash are discharged having an equal velocity profile diametrically across said throat at the exit end thereof.

* * * * *